US008777666B2

(12) United States Patent
Golko et al.

(10) Patent No.: US 8,777,666 B2
(45) Date of Patent: Jul. 15, 2014

(54) PLUG CONNECTOR MODULES

(75) Inventors: Albert J. Golko, Saratoga, CA (US); Craig M. Stanley, Campbell, CA (US); Paul J. Thompson, San Francisco, CA (US); Warren Z. Jones, San Jose, CA (US); Ibuki Kamei, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/607,566

(22) Filed: Sep. 7, 2012

(65) Prior Publication Data

US 2014/0073183 A1 Mar. 13, 2014

(51) Int. Cl.
*H01R 13/648* (2006.01)

(52) U.S. Cl.
USPC ..... 439/607.34; 439/607.55; 439/660

(58) Field of Classification Search
USPC ..... 439/607.34, 607.55, 607.56, 660
See application file for complete search history.

(56) References Cited

U.S. PATENT DOCUMENTS

| | | | |
|---|---|---|---|
| 2,792,557 | A | 5/1957 | Dowick |
| 2,892,990 | A | 6/1959 | Werndl |
| 3,760,335 | A | 9/1973 | Roberts |
| 3,793,614 | A | 2/1974 | Tachick et al. |
| 3,795,037 | A | 3/1974 | Luttmer |
| 4,361,375 | A | 11/1982 | Bailey et al. |
| 4,621,882 | A | 11/1986 | Krumme |
| 4,711,506 | A | 12/1987 | Tanaka |
| 5,040,994 | A | 8/1991 | Nakamoto et al. |
| 5,256,074 | A | 10/1993 | Tan |
| 5,295,843 | A | 3/1994 | Davis et al. |
| 5,380,225 | A | 1/1995 | Inaoka |
| 5,387,110 | A | 2/1995 | Kantner et al. |
| 5,442,243 | A | 8/1995 | Bailey |
| 5,594,284 | A | 1/1997 | Hill et al. |
| 5,785,557 | A | 7/1998 | Davis |
| 5,959,848 | A | 9/1999 | Groves et al. |
| 5,967,833 | A | 10/1999 | Cachina |

(Continued)

FOREIGN PATENT DOCUMENTS

| | | | |
|---|---|---|---|
| CN | 201402871 | Y | 2/2010 |
| CN | 101783466 | A | 7/2010 |

(Continued)

OTHER PUBLICATIONS

International Search Report and Written Opinion for PCT/US2013/038008 dated Aug. 15, 2013, 12 pages.

(Continued)

*Primary Examiner* — Hae Moon Hyeon
(74) *Attorney, Agent, or Firm* — Kilpatrick Townsend & Stockton LLP

(57) ABSTRACT

A plug connector module that includes a metal frame having a base portion, an insertion end and a cavity that extends from the base portion into the insertion end. The insertion end is configured to be inserted into a cavity of a corresponding receptacle connector. A substrate extends through the base portion of the frame and into the insertion end. A first plurality of external contacts is positioned in a first opening and a second plurality of contacts positioned within a second opening. One or more electronic components is coupled to the substrate, and a first encapsulant that covers and environmentally seals the one or more electronic components. A second encapsulant covers and environmentally seals a metal shield and at least a portion of a leg that extends from the shield.

20 Claims, 7 Drawing Sheets

(56) References Cited

U.S. PATENT DOCUMENTS 6,074,225 A 6/2000 Wu et al.
6,086,421 A 7/2000 Wu et al.
6,113,427 A 9/2000 Wu
6,179,627 B1 1/2001 Daly et al.
6,322,394 B1 11/2001 Katoh et al.
6,364,699 B1 4/2002 Hwang et al.
6,410,857 B1 6/2002 Gonya
6,482,045 B2 11/2002 Arai
6,530,793 B2 3/2003 Eichhorn et al.
6,692,311 B1 2/2004 Kamei et al.
6,786,763 B2 9/2004 Wu
6,846,202 B1 1/2005 Schmidt et al.
6,869,320 B2 3/2005 Haas et al.
6,902,432 B2 6/2005 Morikawa et al.
6,948,965 B2 9/2005 Kumamoto et al.
6,948,984 B2 9/2005 Chen et al.
6,962,510 B1 11/2005 Chen et al.
6,964,582 B2 11/2005 Zhuang et al.
6,981,887 B1 1/2006 Mese et al.
7,021,971 B2 4/2006 Chou et al.
7,040,919 B2 5/2006 Yao
7,074,052 B1 7/2006 Ni et al.
7,094,086 B2 8/2006 Teicher
7,094,089 B2 8/2006 Andre et al.
7,160,125 B1 1/2007 Teicher
7,175,444 B2 2/2007 Lang et al.
7,198,522 B1 4/2007 Ho et al.
7,361,059 B2 4/2008 Harkabi et al.
7,363,947 B2 4/2008 Teicher
7,364,445 B1 4/2008 Ni et al.
7,387,539 B2 6/2008 Trenne
7,407,416 B1 8/2008 Rogers et al.
7,435,107 B2 10/2008 Matsumoto et al.
7,442,091 B2 10/2008 Salolmon et al.
7,458,825 B2 12/2008 Atsmon et al.
7,500,861 B2 3/2009 Harkabi et al.
7,537,471 B2 5/2009 Teicher
7,549,896 B2 * 6/2009 Zhang et al. ..... 439/607.01
7,559,805 B1 7/2009 Yi et al.
7,572,153 B2 8/2009 Trenne
7,591,657 B2 9/2009 Teicher
7,594,827 B2 9/2009 Takamoto et al.
7,695,318 B1 4/2010 Wang et al.
7,716,400 B2 5/2010 Raines
7,717,717 B1 5/2010 Lai
7,722,409 B2 5/2010 Takamoto et al.
7,727,027 B2 6/2010 Chiang et al.
7,740,498 B1 6/2010 Orsley
7,841,894 B2 11/2010 Gong et al.
7,892,014 B2 2/2011 Amidon et al.
7,918,685 B1 4/2011 Kruckenberg
8,007,309 B2 8/2011 Fan
8,062,073 B1 11/2011 Szczesny et al.
8,162,696 B2 4/2012 Elbaz et al.
8,246,388 B2 8/2012 Chen et al.
8,277,258 B1 10/2012 Huang et al.
8,282,417 B2 * 10/2012 Xiao ..... 439/607.36
8,287,299 B2 10/2012 Ray et al.
8,461,465 B2 * 6/2013 Golko et al. ..... 174/359
8,517,751 B1 * 8/2013 Golko et al. ..... 439/218
8,517,766 B2 * 8/2013 Golko et al. ..... 439/607.41
8,545,269 B2 * 10/2013 Ore-Yang ..... 439/620.22
8,561,879 B2 * 10/2013 Jol et al. ..... 228/179.1
8,573,995 B2 * 11/2013 Golko et al. ..... 439/218
8,647,156 B2 2/2014 Golko et al.
8,708,745 B2 4/2014 Golko et al.
2003/0016509 A1 1/2003 Tsukamoto
2003/0207606 A1 11/2003 Ho
2004/0229515 A1 11/2004 Kaneda et al.
2005/0042930 A1 2/2005 Harkabi et al.
2005/0079738 A1 4/2005 Ahn
2005/0085136 A1 4/2005 Zhang
2005/0124217 A1 6/2005 Zhuang et al.
2005/0124218 A1 6/2005 Chen et al.
2005/0124219 A1 6/2005 Chen et al.
2005/0202727 A1 9/2005 Andre et al.
2006/0019545 A1 1/2006 Moriyama et al.
2006/0024997 A1 2/2006 Teicher
2006/0040549 A1 2/2006 Yao
2006/0148300 A1 7/2006 Huang et al.
2006/0216991 A1 9/2006 Boutros
2006/0289201 A1 12/2006 Kim et al.
2007/0010115 A1 1/2007 Teicher
2007/0010116 A1 1/2007 Teicher
2007/0037452 A1 2/2007 Martin et al.
2007/0049100 A1 3/2007 Tsai
2007/0072442 A1 3/2007 DiFonzo
2007/0082701 A1 4/2007 Seil et al.
2007/0178771 A1 8/2007 Goetz et al.
2007/0202725 A1 8/2007 Teicher
2007/0243726 A1 10/2007 Trenne
2008/0032562 A1 2/2008 McHugh et al.
2008/0067248 A1 3/2008 Hiew et al.
2008/0090465 A1 4/2008 Matsumoto et al.
2008/0119076 A1 5/2008 Teicher
2008/0167828 A1 7/2008 Terlizzi et al.
2008/0274633 A1 11/2008 Teicher
2008/0309313 A1 12/2008 Farrar et al.
2009/0004923 A1 1/2009 Tang et al.
2009/0108848 A1 4/2009 Lundquist et al.
2009/0117768 A1 5/2009 Liao
2009/0156027 A1 6/2009 Chen
2009/0180243 A1 7/2009 Lynch et al.
2010/0009575 A1 1/2010 Crooijmans et al.
2010/0062656 A1 3/2010 Lynch et al.
2010/0104126 A1 4/2010 Greene
2010/0171465 A1 7/2010 Seal et al.
2010/0248544 A1 9/2010 Xu et al.
2010/0254602 A1 10/2010 Yoshino
2010/0254662 A1 10/2010 He et al.
2010/0267261 A1 10/2010 Lin et al.
2010/0267262 A1 10/2010 Lin et al.
2011/0136381 A1 6/2011 Cho
2011/0159719 A1 6/2011 Takahashi et al.
2011/0201213 A1 8/2011 Dabov et al.
2011/0250786 A1 10/2011 Reid
2011/0294354 A1 12/2011 Chen et al.
2011/0312200 A1 12/2011 Wang et al.
2012/0028495 A1 2/2012 Su et al.
2013/0075149 A1 3/2013 Golko et al.
2013/0078869 A1 3/2013 Golko et al.
2013/0089291 A1 4/2013 Jol et al.
2013/0095701 A1 4/2013 Golko et al.
2013/0095702 A1 4/2013 Golko et al.
2013/0115821 A1 5/2013 Golko et al.
2013/0122754 A1 5/2013 Golko et al.
2013/0149911 A1 6/2013 Golko et al.
2013/0217253 A1 * 8/2013 Golko et al. ..... 439/345
2013/0244491 A1 * 9/2013 Sarwar et al. ..... 439/655
2013/0244492 A1 * 9/2013 Golko et al. ..... 439/660
2014/0068933 A1 3/2014 Brickner et al.
2014/0069709 A1 3/2014 Schmidt et al.
2014/0073193 A1 3/2014 SooHoo et al.

FOREIGN PATENT DOCUMENTS

CN 201533091 U 7/2010
DE 19609571 A1 11/1995
DE 202004021354 U1 9/2007
EP 0081372 A2 6/1983
EP 1684391 A2 7/2006
EP 1717910 A2 11/2006
EP 2169774 A1 3/2010
EP 2373131 A1 10/2011
JP 2078171 A 3/1990
JP 8321360 A 12/1996
JP 2003217728 A 7/2003
JP 2004079491 A 3/2004
TW M318831 U 9/2007
TW M350153 U 2/2009
WO 2004097995 A1 11/2004
WO 2005013436 A1 2/2005
WO 2005124932 A2 12/2005
WO 2006013553 A2 2/2006

(56) References Cited

FOREIGN PATENT DOCUMENTS

| | | | |
|---|---|---|---|
| WO | 2006074348 | A1 | 12/2006 |
| WO | 2008065659 | A2 | 6/2008 |
| WO | 2009069969 | A2 | 6/2009 |
| WO | 2009140992 | A1 | 11/2009 |
| WO | 2011043488 | A1 | 4/2011 |
| WO | 2011150403 | A1 | 12/2011 |
| WO | 2011163256 | A1 | 12/2011 |
| WO | 2013070767 | A1 | 5/2013 |
| WO | 2013082175 | A2 | 6/2013 |

OTHER PUBLICATIONS

Flipper Press Release (Jun. 25, 2012) and Data Sheet: http://www.flipperusb.com/images/flipperUSB-brochure.pdf.

International Search Report and Written Opinion for International PCT Application No. PCT/US2013/038008, mailed Aug. 15, 2013, 12 pages.

Extended European Search Report, EP App. No. 13165892.4, mailed Dec. 20, 2013, 6 pages.

* cited by examiner

PLUG CONNECTOR MODULES

BACKGROUND OF THE INVENTION

The present invention relates generally to electrical connectors and in particular to connector modules that can readily be incorporated into electronic devices and cables.

A wide variety of electronic devices are available for consumers today. Many of these devices have connectors that that facilitate communication with and/or charging of a corresponding device. Typically these connectors are part of a male plug connector and female receptacle connector system in which the plug connector can be inserted into and mated with the receptacle connector so that digital and analog signals can be transferred between the contacts in each connector. More often than not, the female connector in the connector system is included in a host electronic device such as a portable media player, a smart phone, a table computer, a laptop computer, a desktop computer or the like. More often than not, the plug connector in the connector system is included in an accessory device such as a charging cable, a docking station or an audio sound system. In some instances, however, devices, for example cable adapters, include both receptacle and plug connectors. Also, in some instances, the plug connector/receptacle connector pairing can be part of a large ecosystem of products that includes both host electronic devices and accessory devices designed to work together. Thus, the same format plug connector can be incorporated into many different accessories, which in turn can be designed to operate with multiple different host devices that include the corresponding receptacle connector.

The various accessories and devices that are part of the ecosystem may be manufactured by many different companies in many different locations throughout the world. The connectors, on the other hand, may be manufactured by companies different than those that manufacture the accessories and device and may be manufactured at different locations. Thus, the connectors may be shipped from a connector manufacturing facility to another manufacturing facility.

BRIEF SUMMARY OF THE INVENTION

Embodiments of the invention pertain to plug connectors modules that have been designed and manufactured to be incorporated into various electronic devices and accessories. While the plug connector modules can be incorporated into an electronic device or accessory at the same location where the module is manufactured, the modules are particularly well suited to be shipped to other manufacturing facilities away from the location that the module was manufactured.

Some embodiments of connector modules according to the present invention include a frame that defines an external connector tab that is adapted to be inserted into a corresponding receptacle connector. The frame supports a plurality of external contacts on first and second opposing sides of the tab. A substrate, such as a printed circuit board (PCB), is housed within the frame and includes contact bonding pads coupled to the contacts, as well as various electronic components that are part of the connector and conductor bonding pads that enable the connector to be operatively coupled to the electronic device or accessory that it is later incorporated into. A shield can, made out of metal or another suitable conductive material, can be bonded to a rear portion of the frame to enclose a portion of the PCB that extends outside the frame. The connector tab and electronic components can be environmentally sealed leaving the conductor bonding pads exposed so that they can be bonded to at a later time. In some embodiments, the shield can includes substantially flat extension portions on each of side of the shield can and each extension portion includes at least one holes that facilitates attaching the shield can and thus the connector module to an electronic device or assembly.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION OF THE INVENTION

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

Figure 1A:
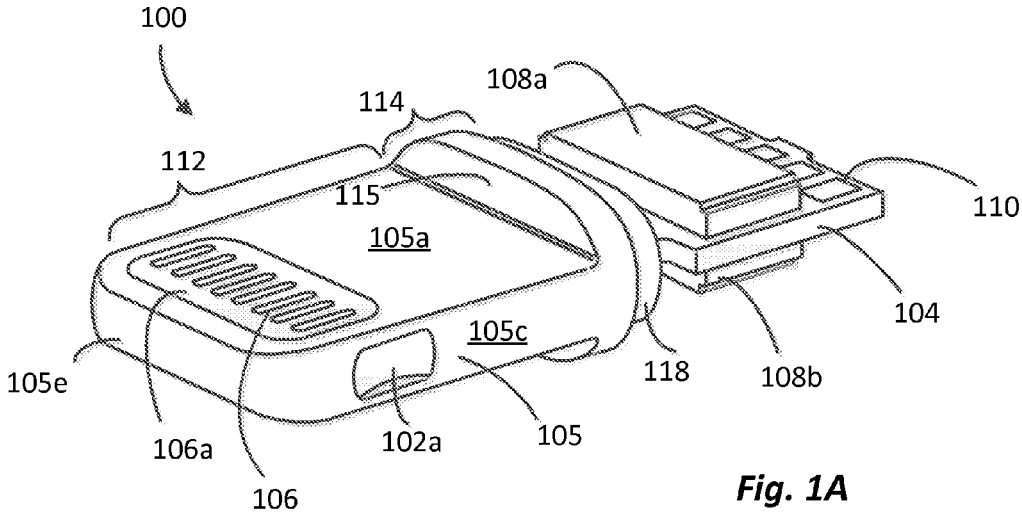
FIG. 1A is a simplified perspective view of a plug connector 100 that can be part of a connector module according to some embodiments of the present invention.
Figure 1B:
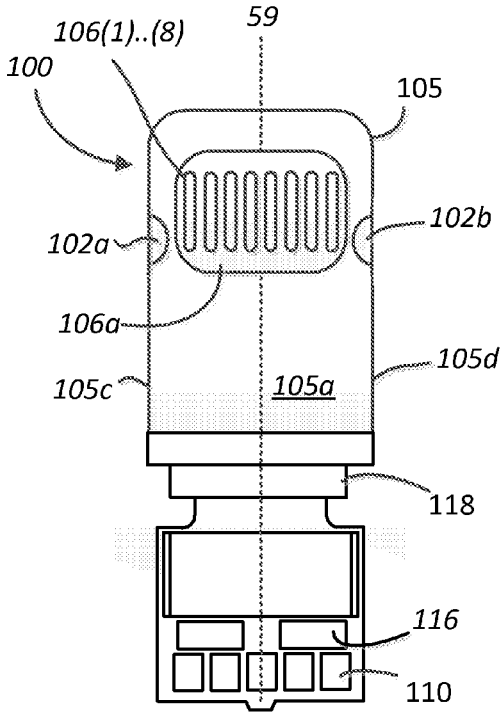
FIGS. 1B and 1C are simplified top and bottom views, respectively, of connector 100 shown in FIG. 1.
Figure 1C:
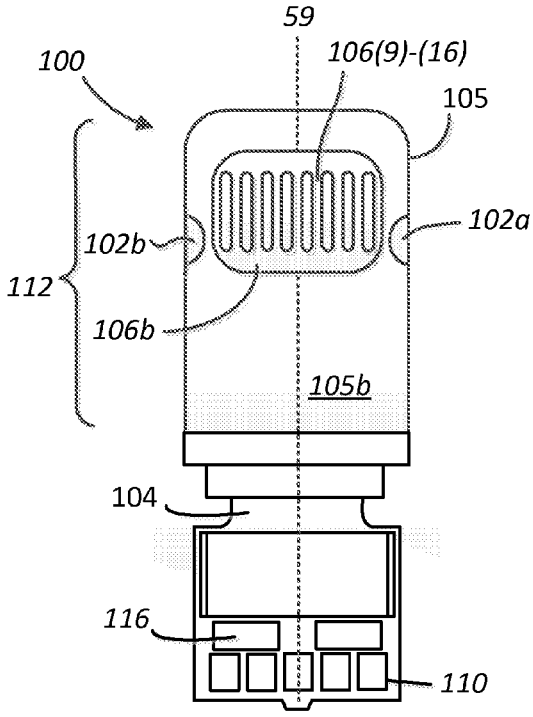

Referring first to FIGS. 1A-1C which depict a partially formed connector 100 according to an embodiment of the invention. FIG. 1A is a simplified perspective view of connector 100 and FIGS. 1B and 1C are simplified top and bottom plan views, respectfully, of connector 100. At this stage of manufacture, connector 100 includes a frame 105 and a plurality of contacts 106 positioned at an external surface of the connector. Frame 105 provides structural support for connector 100 and contacts 106 and includes an insertion end 112 and a flange end 114 at a base portion of frame 105. Insertion end 112 is configured to be inserted into a corresponding receptacle connector during a mating event and flange end 114 provides both a face 115 that can act as a stopping point for the mating event and a rim 118. In one connector 100 is a dual orientation connector that can be inserted into its receptacle in either of two orientations rotated 180 degrees from each other and insertion end 112 has 180 degree symmetry. Frame 105 can be made from metal or any other appropriate conductive material. In one particular embodiment, frame 105 is made from stainless steel and can be referred to as a ground ring.

The insertion end of connector 100 includes first and second opposing sides 105*a*, 105*b* extending in the width and length dimensions of the frame, third and fourth opposing sides 105*c*, 105*d* extending between the first and second sides in the height and length dimensions, and an end 105*e* extending in the width and height dimensions between the first and second sides as well as between the third and fourth sides at the distal end of the connector. Sides 105*a*-105*e* frame an interior cavity (not shown) that can house portions of connector 100. In some embodiments, insertion end 112 of connector 100 is between 5-10 mm wide, between 1-3 mm thick and has an insertion depth (the distance from the tip of tab 44 to spine 109) of between 5-15 mm. Also in some embodiments, insertion end 112 has a length that is greater than its width which is greater than its thickness. In other embodiments, the length and width of insertion end 112 are within 0.2 mm of each other. In one particular embodiment, insertion end 112 is 6.7 mm wide, 1.5 mm thick and has an insertion depth (the distance from the tip of insertion end 112 to face 115 of between 6-8 mm, and in one particular implementation an insertion depth of 6.6 mm.

Contacts 106 can be formed on a single side of connector 100 or on both sides and can be any number of contacts arranged in any effective manner. In the embodiment shown in FIGS. 1A-1C, contacts 106 include a first set of eight contacts spaced in a single row on side 105*a* of the connector as well as second set of eight contacts spaced in a single row on opposing side 105*b* of the connector. For convenience, the contacts are numbered in FIGS. 1A-1C as contacts 106(1) . . . 106(8) on the first side and 106(9) . . . 106(16) on the second side. First and second sets of contacts are formed in contact regions 106*a*, 106*b*, respectively, which are defined by first and second openings in frame 105 that have dielectric material space between the contacts and between the contacts and the frame as described below. Contacts 106 can be made from any appropriate conductive material such as copper and plated with gold and can be used to carry a wide variety of signals including digital signals and analog signals as well as power and ground as previously discussed. In one embodiment, each contact 106 has an elongated contact surface. In one embodiment the overall width of each contact is less than 1.0 mm at the surface, and in another embodiment the width is between 0.75 mm and 0.25 mm. In one particular embodiment, a length of each contact is at least 3 times as long at the surface than its width, and in another embodiment a length of each contact 106(*i*) is at least 5 times as long at the surface than its width Connector 100 also includes retention features 102*a*, 102*b* formed as curved pockets in the sides of frame 105 that are adapted to engage with one or more features on the corresponding receptacle connector to secure the connectors together when the plug connector is inserted into the receptacle connector.

A substrate 104, such as a printed circuit board (PCB) is housed within frame 105. As shown in FIGS. 1A-1C, a portion of substrate 104 extends out past the rear opening of the frame. Substrate 104 includes a plurality of contact bonding pads (not shown) that can correspond in number to the plurality of contacts 106 and that are positioned directly beneath the contacts in contact regions 106*a*, 106*b*. Substrate 104 also includes one or more electronic components 108*a*, 108*b*, such as integrated circuits, a plurality of conductor bonding pads 110 and ground pads 116. Each bonding pad can be connected to one or more contact bonding pads by electrical traces that run along substrate 104 (not shown).

In some embodiments, electronic components 108*a*, 108*b* may include one or more integrated circuits (ICs), such as Application Specific Integrated Circuit (ASIC) chips that provide information regarding connector 100 and any accessory or device that connector 100 is part of and/or to perform specific functions, such as authentication, identification, contact configuration and current or power regulation. As an example, in one embodiment an identification (ID) module is embodied within an IC operatively coupled to the contacts of connector 100. The ID module can be programmed with identification and configuration information about the connector and/or its associated accessory that can be communicated to a host device during a mating event. As another example, an authentication module programmed to perform an authentication routine, for example a public key encryption routine, with circuitry on the host device can be embodied within an IC operatively coupled to connector 100. The ID module and authentication module can be embodied within the same IC or within different ICs. As still another example, in embodiments where connector 100 is part of a charging accessory, a current regulator can be embodied within one of IC's 108*a* or 108*b*. The current regulator can be operatively coupled to contacts that are able to deliver power to charge a battery in the host device and regulate current delivered over those contacts to ensure a constant current regardless of input voltage and even when the input voltage varies in a transitory manner.

Figure 2:
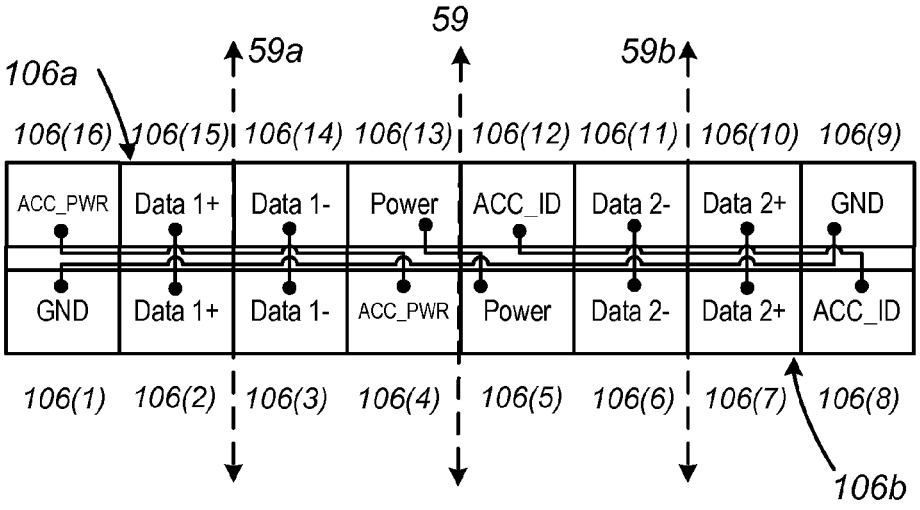
FIG. 2 is a diagram illustrating a pinout arrangement of connector 100 according to one embodiment of the invention.

FIG. 2 depicts an implementation of a pinout for one particular embodiment of plug connector 100. The depicted pinout includes eight contacts 106(1) . . . 106(8) on each side of connector 100 that can correspond to the contacts in FIGS. 1A-1C. Each contact in contact region 106*a* is electrically connected via connections on or through substrate 104 to a corresponding contact in contact region 106*b*. Thus, the sixteen contacts of connector 100 act as eight electrically distinct contacts. Some of the connected contacts are mirrored contacts (i.e., electrically connected to a contact directly opposite itself) while other contacts are in a cater corner relationship with each other across either a centerline 59 of the connector or across one of two quarter lines 59*a*, 59*b* of the connector as described below (as used herein, the term "quarter line" does not encompass the centerline).

Specifically, as shown in FIG. 2 the depicted pinout includes a first pair of mirrored data contacts (Data 1) and a second pair of mirrored data contacts (Data 2) where each individual mirrored data contact is electrically connected to a corresponding data contact directly opposite itself on the opposing side of the connector. A power contact (Power) includes two contacts positioned in a cater corner relationship with each other across centerline 59-contacts 106(5), 106(13), while the ground contact (GND) includes two contacts positioned in a cater corner relationship with each other across centerline 59-contacts 106(1), 106(9). The accessory power contact (ACC_PWR) and accessory ID contact (ACC_ID), on the other hand, are positioned in a cater corner relationship with counterpart contacts across quarter lines 59*a* and 59*b*, respectively.

Power contact (Power) can be sized to handle any reasonable power requirement for a portable electronic device, and for example, can be designed to carry between 3-20 Volts from an accessory to charge a host device connected to connector 100. Ground contact (GND) provides a dedicated ground contact at one end of the row of contacts as far away as possible from the power contact. Ground is also provided through the ground ring 105 via contacts in the side of the corresponding receptacle connector within retention features 102*a*, 102*b*. The additional, dedicated ground contact within contact regions 106*a*, 106*b*, however, provides additional ground coverage and provides a benefit in that the contact integrity of the ground contacts 106(1), 106(9) can be specifically designed to carry the electrical ground signal (e.g., using gold plated copper contacts) without being constrained by the hardness or other requirements associated with the contacts in the side of ground ring 105 that ensure the ground ring is sufficiently robust to withstand multiple thousands of use cycles.

Each pair of data contacts, Data 1 and Data 2, can be positioned between one of the Power or GND contacts, each of which carries a DC signal, and one of the ACC_PWR or ACC_ID contacts, which carry either a lower voltage accessory power signal (a DC signal) or a relatively low speed accessory ID signal. The data contacts can be high speed data lines that operate at rate that is at least two orders of magnitude faster than that of the accessory ID signal making it look essentially like a DC signal to the high speed data lines. Thus, positioning the data contacts between either the power contacts or ground contacts and the ACC contacts improves signal integrity by sandwiching the data contacts between contacts designated for DC signals or essentially DC signals.

In one embodiment, the pinout of FIG. 2 represents the signal assignments of a plug connector 100 in a plug connector/receptacle connector pairing that can be the primary physical connector system for an ecosystem of products that includes both host electronic devices and accessory devices. Examples of host devices include smart phones, portable media players, tablet computers, laptop computers, desktop computers and other computing devices. An accessory can be any piece of hardware that connects to and communicates with or otherwise expands the functionality of the host. Many different types of accessory devices can be specifically designed or adapted to communicate with the host device through connector 100 to provide additional functionality for the host. Plug connector 100 can be incorporated into each accessory device that is part of the ecosystem to enable the host and accessory to communicate with each other over a physical/electrical channel when plug connector 100 from the accessory is mated with a corresponding receptacle connector in the host device. Examples of accessory devices include docking stations, charge/sync cables and devices, cable adapters, clock radios, game controllers, audio equipment, memory card readers, headsets, video equipment and adapters, keyboards, medical sensors such as heart rate monitors and blood pressure monitors, point of sale (POS) terminals, as well as numerous other hardware devices that can connect to and exchange data with the host device.

It can be appreciated that some accessories may want to communicate with the host device using different communication protocols than other accessories. For example, some accessories may want to communicate with the host using a differential data protocol, such as USB 2.0, while other accessories may want to communicate with the host using an asynchronous serial communication protocol. In one embodiment the two pairs of data contacts (Data 1 and Data 2) can be dedicated to two pairs of differential data contacts, two pairs of serial transmit/receive contacts, or one pair of differential data contacts and one pair of serial transmit/receive contacts depending on the purpose of connector 100 or function of the accessory connector 100 is part of. As an example that is particularly useful for consumer-oriented accessories and devices, the four data contacts can accommodate two of the following three communication interfaces: USB 2.0, Mikey Bus or a universal asynchronous receiver/transmitter (UART) interface. As another example that is particularly usefully for debugging and testing devices, the set of data contacts can accommodate two of either USB 2.0, UART or a JTAG communication protocols. In each case, the actual communication protocol that is used to communicate over a given data contact can depend on the accessory as discussed below.

As mentioned above, connector 100 may include one or more integrated circuits that provide information regarding the connector and any accessory or device it is part of and/or perform specific functions. The integrated circuits may include circuitry that participates in a handshaking algorithm that communicates the function of one or more contacts to a host device that connector 100 is mated with. For example, an ID module can be embodied within IC 108*a* as discussed above and operatively coupled to the ID contact (ACC_ID) and an authentication module can be embodied in IC 108*a* with the ID module or in a separate IC, such as IC 108*b*. The ID and authentication modules each include a computer-readable memory that can be programmed with identification, configuration and authentication information relevant to the connector and/or its associated accessory that can be communicated to a host device during a mating event. For instance, when connector 100 is mated with a receptacle connector in a host electronic device, the host device may send a command over its accessory ID contact (that is positioned to align with the ID contact of the corresponding plug connector) as part of a handshaking algorithm to determine if the accessory is authorized to communicate and operate with the host. The ID module can receive and respond to the command by sending a predetermined response back over the ID contact. The response may include information that identifies the type of accessory or device that connector 100 is part of as well as various capabilities or functionalities of the device. The response may also communicate to the host device what communication interface or communication protocol the connector 100 employs on each of data contact pairs Data 1 and Data 2. If connector 100 is part of a USB cable, for example, the response sent by the ID module may include information that tells the host device that contacts in the first data pair, Data 1, are USB differential data contacts. If connector 100 is a headset connector, the response may include information that tells the host that contacts in the second data pair, Data 2, are Mikey Bus contacts. Switching circuitry within the host can then configure the host circuitry operatively coupled to the contacts in the receptacle connector accordingly.

During the handshaking routine the authentication module can also authenticate connector 100 (or the accessory it is part of) and determine if connector 100 (or the accessory) is an appropriate connector/accessory for the host to interact with using any appropriate authentication routine. In one embodiment authentication occurs over the ID contact prior to the identification and contact switching steps. In another embodiment authentication occurs over one or more of the data contacts after they are configured according to a response sent by the accessory.

Figure 3:
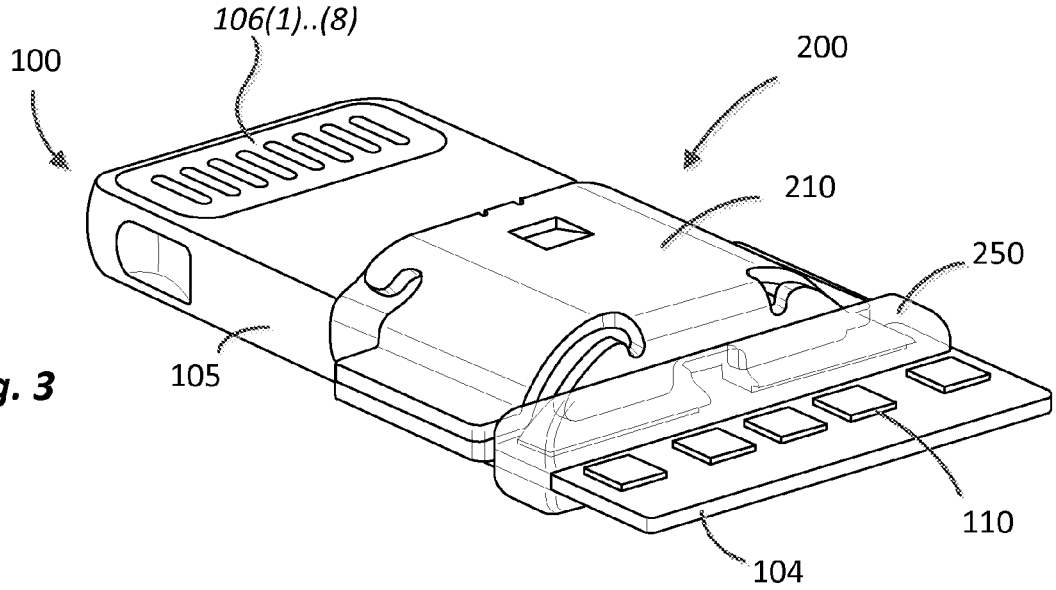
FIG. 3 is a simplified perspective view of a plug connector module 200 according to one embodiment of the present invention.
Figure 4:
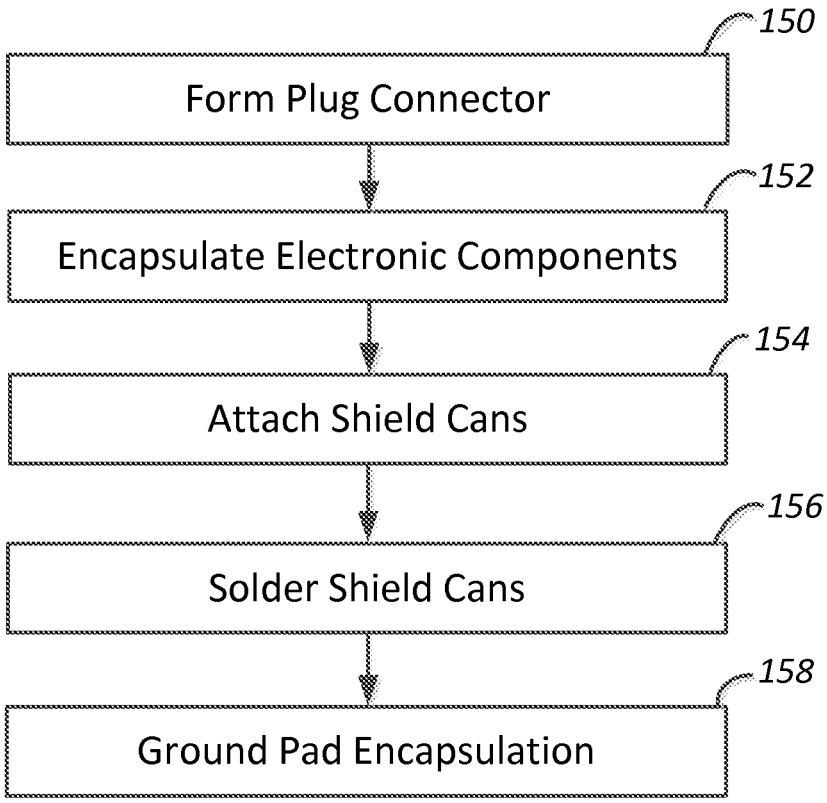
FIG. 4 is a flowchart depicting steps associated with manufacturing connector module 200 according to one embodiment of the invention.

Reference is now made to FIGS. 3 and 4, where FIG. 3 is a simplified perspective view of a connector module 200 according to an embodiment of the invention that is particularly useful in the manufacture of connector cables and cable adapters, and FIG. 4 is a flow chart depicting the steps associated with manufacturing module 200 according to one embodiment. As shown in FIG. 3, connector module 200 includes connector 100 along with a shield can 210 and various encapsulants, such as ground pad encapsulant 250, that protect the electronic components and other portions of connector 100 from moisture. As shown in FIG. 3, conductor contact pads 110 are not enclosed within shield can 210 or encased within encapsulant. Instead, conductor contact pads 110 are positioned at the end of substrate 104 and readily available to be bonded to by wires, a flex circuit or other type of conductor when connector module 200 is incorporated into an electronic device or cable.

Figure 5A:
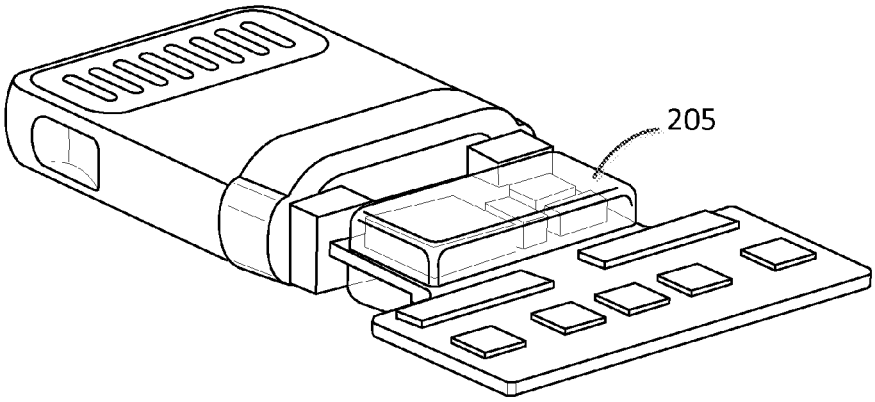
FIGS. 5A-5D are simplified perspective views depicting connector module 200 at different stages of manufacture discussed with respect to FIG. 4 according to an embodiment of the present invention.

Module 300 can be formed by starting with plug connector 100 (FIG. 4, step 150) and encapsulating all the various electronic components formed on substrate 104 with a liquid encapsulant that will seal the components and protect them from moisture and other environmental components (FIG. 4, step 152). The liquid encapsulant can be applied over each side of substrate 104 to fully cover each of electronic components 108*a*, 108*b* and others that are attached to the substrate. In one embodiment, encapsulant is a UV/moisture curably acylate polymer applied using in jet dispense operation over each side individually. The polymer is then cured to form a substantially rectangular block of encapsulant 205 that fully encases the electronic components and a portion of substrate 104 as shown in FIG. 5A.

Figure 5B:
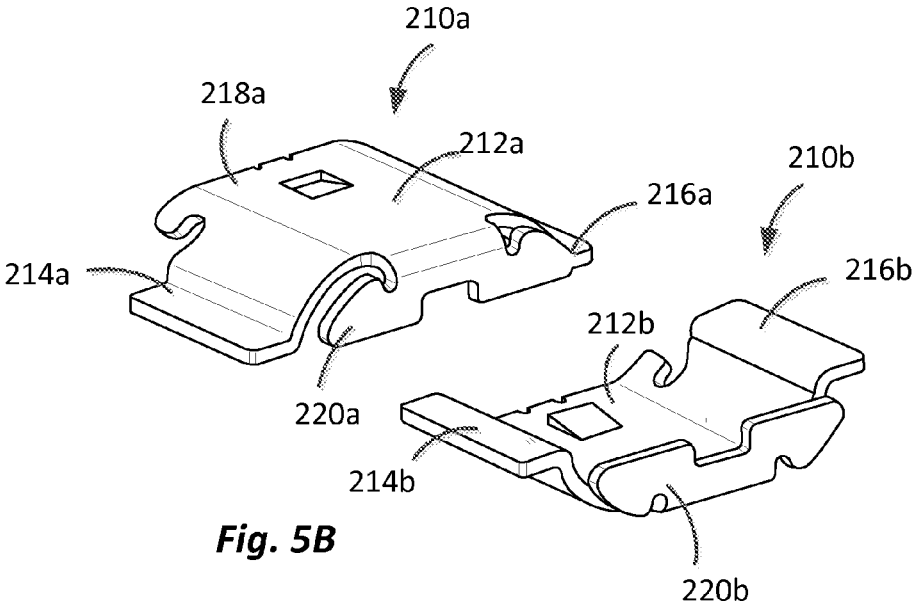
Figure 5C:
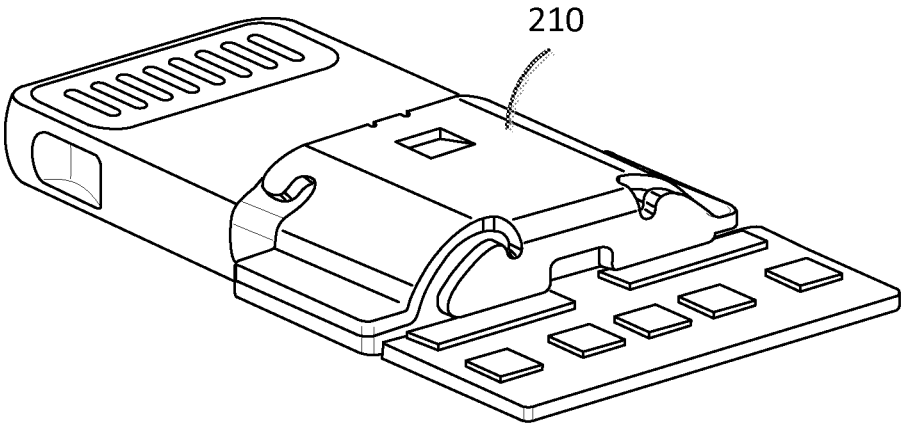

Next, metal shield can 210 is attached to ground ring 105 and substrate 104 (step 154; FIG. 5B). In one embodiment, shield can 210 includes two halves 210*a*, 210*b* as shown in FIG. 5C that are identical and are machined from, for example, stainless steel. Reference numbers for elements in each shield include a surface of either a or b in the FIG. 5C depending on whether the component is part of shield can 210*a* or shield can 210*b*. Since the elements are identical in each shield can, however, for convenience of description the suffix is mostly left out of the discussion below. Each half includes a curved surface 212 that extends from a first mating plate 214 to a second mating plate 216. Each of mating plates 214, 216 provides a substantially flat portion at an outer periphery.

Figure 5D:
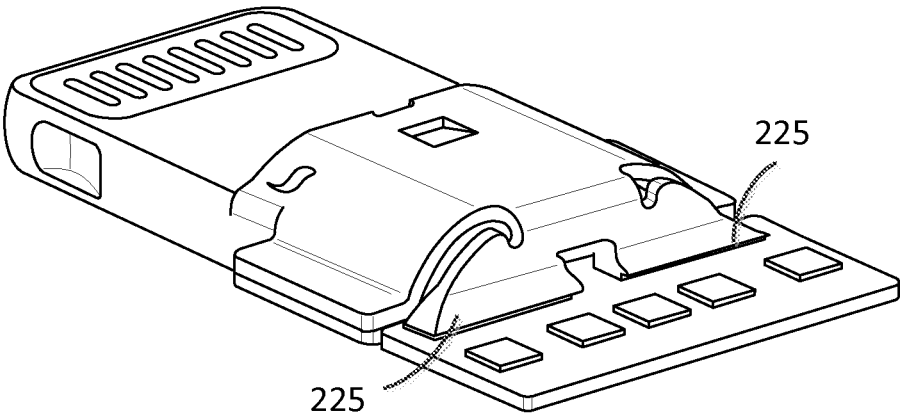

Shield cans 210*a* and 210*b* can each be positioned on connector module 200 such that a head portion 218 of the shield cans is in contact with rim 118. In this alignment, the head portion 218 can be welded to rim 118, mating plate 214*a* can be welded to plate 214*b* and plate 216*a* can be welded to plate 216*b* (step 154). Each shield can 210*a*, 210*b* further includes a leg 220 that aligns with bonding pads 112, which are connected to ground. After the shield cans are firmly welded to each other and to ground ring 105, legs 220*a* and 220*b* can be soldered to the bonding pads to form solder bonds 225 to further secure the shield cans to the connector and further connected the shield can to ground (step 156; FIG. 5D). A second encapsulation step then covers the soldered legs and ground pads 112 with a liquid encapsulant that will further seal the connector module to protect it from moisture and other environmental components (step 158). As with step 152, the liquid encapsulant can be applied over each side of substrate 104 to fully cover ground pads 112 and shield can legs 220*a*, 220*b*. In one embodiment, encapsulant is a UV/moisture curably acylate polymer applied in jet dispense operation over each side individually. The polymer is then cured to form a substantially rectangular block of encapsulant 250 that fully encases ground pads and a bottom portion of legs 220*a*, 220*b* as shown in FIG. 3.

Shield cans 210*a*, 210*b* can also be welded to rim 118 of ground ring 105 along. Once the shield cans are welded to each other and to ground ring 105, they form an enclosure around a portion of connector module 200 that extends from the flange end of ground ring 205 to the connector bonding pads covering encapsulant block 205 and other portions of the connector. Also, the half shield cans are sized to be welded to each other. 210A, 210B s218 portion includes a front bonding po attachment section applied can the components on each side of substrate 104.

Figure 6:
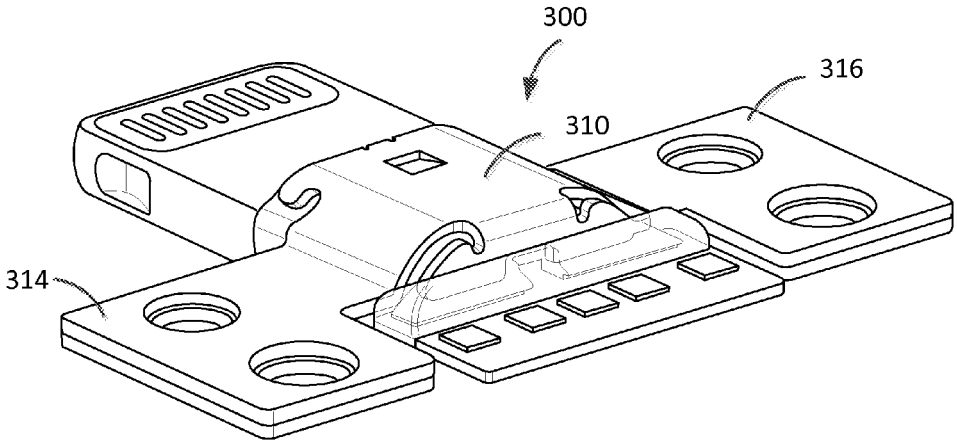
FIG. 6 is a simplified perspective view of a plug connector module 300 according to another embodiment of the present invention.
Figure 7:
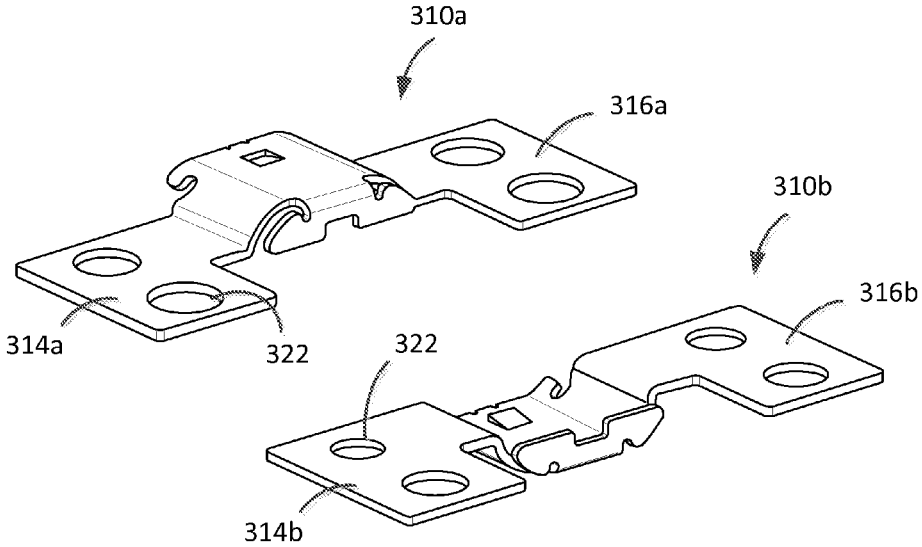
FIG. 7 is a simplified perspective view of a shield cans used in the manufacture of connector module 300 according to an embodiment of the present invention.

FIG. 6 is a simplified perspective view of a plug connector module 300 according to another embodiment of the present invention. Connector module 300 is similar to connector module 200 except that shield cans 310*a*, 310*b* (shown in FIG. 7) that enclose the electronic components and initial encapsulant block 205 include wings 314 and 316 that extend out of the shield can in a plane substantially parallel to substrate 104 and provide a substantially flat mating surface similar to mating portions 214, 216. Wings 314, 316 also provide additional real estate for one or more holes 322. Each of holes 322 in wing 314*a* aligns with a corresponding hole in wing 314*b* and each hole 322 in wing 316*a* aligns with a corresponding hole in wing 314*b*. This enables holes 322 to be used as an attachment point, for example with a screw and nut assembly or a rivet or any other suitable attachment means, to secure connector module 300 to an electronic device or accessory that it is incorporated into. To provide a more secure connection, some embodiments include two holes 322 spaced apart along a length of each wing 314, 316.

Figure 8:
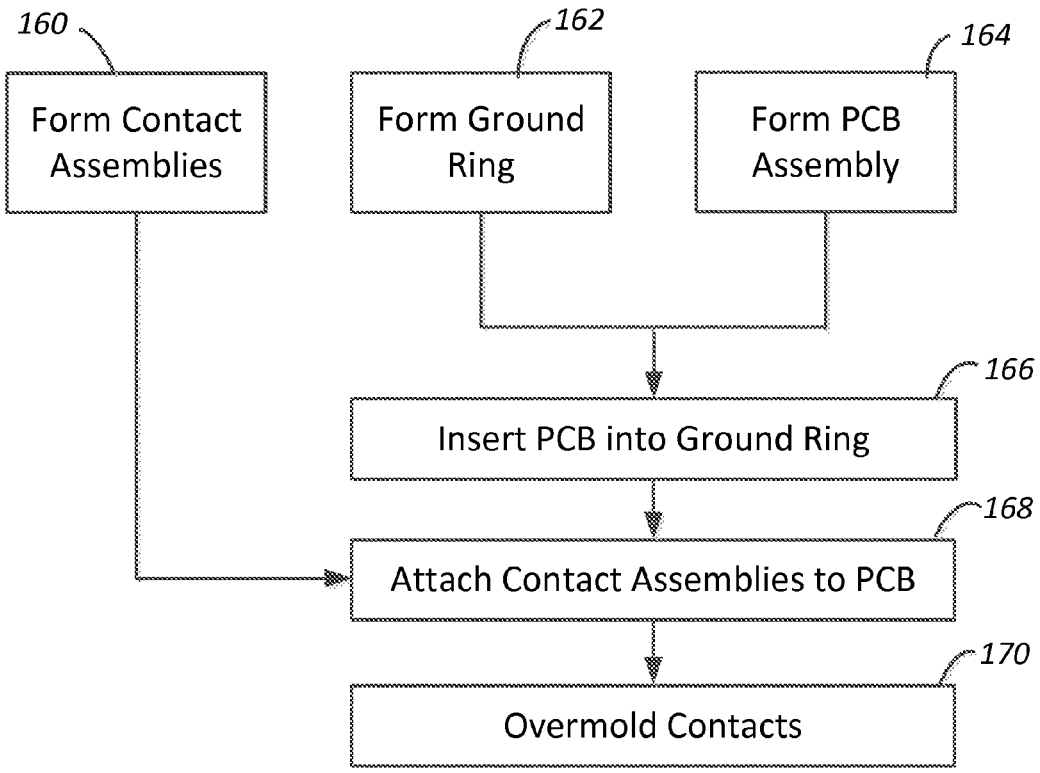
FIG. 8 is a flowchart depicting additional steps associated with manufacturing connector modules 200 and 300 according to an embodiment of the invention.

Reference is now made to FIG. 8 regarding the steps associated with the manufacture and assembly of connector 100 according to one embodiment of the invention (FIG. 4, step 150). Connector 100 includes three primary parts: ground ring 105, substrate 104 with attached electronic components, and a contact assembly that includes a dielectric frame that supports each of the individual contacts 106. These three components can be manufactured separate from each other (steps 160, 162 and 164) and are brought together in a final assembly process to be assembled in connector 100.

Ground ring 105 may be fabricated using a variety of techniques such as, for example, a metal injection molding process (MIM), a cold heading process or a billet machining process. A MIM process may provide a great deal of flexibility in achieving a desired geometry and can result in a part that is close to the final desired shape with minimal post machining operations. In some embodiments, alternative processes such as plastic injection molding and plating may be used to form ground ring 105. Pockets 102*a*, 102*b* and the openings that form contact regions 106*a*, 106*b* may be machined or molded into the ground ring as well. The surface of the ground ring can be smoothed using a media blasting process. Further, it may be desirable to grind or machine surfaces of the ground ring such as flats 105*a*, 105*b* on the top and bottom of the ground ring and plate the ground ring with one or more metals to achieve a desired finish. Grinding and machining operations can be used to create tightly toleranced features. Tightly toleranced component geometry may be beneficial for subsequent assembly operations and may further benefit the performance of particularly small connectors.

Substrate 104 may be a traditional epoxy and glass PCB or may be any equivalent structure capable of routing electrical signals. For example, some embodiments may use a flexible structure comprised of alternating layers of polyimide and conductive traces while other embodiments may use a ceramic material with conductive traces or a plastic material processed with laser direct structuring to create conductive traces. The PCB may be formed with a set of conductor bonding pads 110 disposed at one end, ground pads 112 disposed adjacent to the pads 110 and a set of contact bonding pads (not shown) disposed at the opposing end. The PCB may also be equipped with one or more ground spring bonding pads to electrically connect one or more ground springs that provide spacing between substrate 104 and the inner edges of ground ring 105 when the substrate is inserted into the ground ring. Additionally, a set of component bonding pads may be formed on the substrate to electrically connect one or more active or passive electronic components as previously discussed. Such components can be attached with a conductive epoxy, a solder alloy or by using myriad other technologies, such as, through-hole mounting, stencil print and reflow, chip-on-board, flip-chip and the like.

The first step of the assembly process may involve inserting substrate 104 through a back opening of ground ring 105 so that the contact bonding pads and their solder bumps formed on the substrate are positioned within the windows of the ground ring (step 166). Next, the contact assemblies may be positioned within each window of ground ring 105 so the contacts in each assembly can be attached to substrate 104 (step 168). Each contact assembly may include a molded frame that can be formed from a dielectric material such as polypropylene that is insert molded around the contacts while the contacts are still attached to a lead frame. The contacts can then be pressed into the solder and heated with a hot bar to form solder joints between each contacts and its respective solder bump. After the contacts are connected to substrate 104, dielectric material may be injected into ground ring 105, for example from the back opening of the ground ring, around substrate 104 and around each of contacts 106 (step 170) forming a substantially flush exterior surface between the dielectric and contacts in each of contact regions 106*a*, 106*b*. The dielectric material may be polyoxymethylene (POM), a nylon-based polymer or other suitable dielectric and provides structural strength to connector 100 as well as moisture protection by sealing internal components of the connector from the outside environment. After the dielectric molding process, the partially completed connector is ready to be encapsulated by either shield cans 210 or 310 as described above with respect to FIG. 4.

As will be understood by those skilled in the art, the present invention may be embodied in many other specific forms without departing from the essential characteristics thereof. Also, while a number of specific embodiments were disclosed with specific features, a person of skill in the art will recognize instances where the features of one embodiment can be combined with the features of another embodiment. For example, some specific embodiments of the invention set forth above were illustrated with pockets as retention features. A person of skill in the art will readily appreciate that any of the other retention features described herein, as well as others not specifically mentioned, may be used instead of or in addition to the pockets. Also, those skilled in the art will recognize, or be able to ascertain using no more than routine experimentation, many equivalents to the specific embodiments of the inventions described herein. Such equivalents are intended to be encompassed by the following claims.

What is claimed is:

1. A plug connector module comprising:

a metal frame having a base portion, an insertion end and a cavity that extends from the base portion into the insertion end, the insertion end being configured to be inserted into a cavity of a corresponding receptacle connector and having width, height and length dimensions along with first and second opposing exterior surfaces extending in the width and length dimensions, the first exterior surface including a first opening and the second exterior surface including a second opening directly opposite the first opening;

a substrate that extends through the base portion of the frame and into the insertion end, the substrate having a plurality of contact bonding pads at one end positioned within the frame, a plurality of conductor bonding pads at the opposing end and at least one ground pad contact between the contact bonding pads and conductor bonding pads;

a first plurality of external contacts positioned within the first opening and bonded to some of the plurality of contact bonding pads on the substrate;

a second plurality of contacts positioned within the second opening and bonded to some of the plurality of contact bonding pads on the substrate;

one or more electronic components coupled to the substrate;

a first encapsulant that covers and environmentally seals the one or more electronic components;

a metal shield coupled to the base portion of the metal frame and encasing a portion of the substrate and the one or more electronic components, the metal shield having a leg that is substantially perpendicular to the substrate and coupled to the substrate at the ground pad; and a second encapsulant that covers and environmentally seals the ground pad and at least a portion of the leg.

2. The plug connector module set forth in claim 1 wherein the metal shield comprises first and second halves that are welded to the base portion and welded to each other at mating plates on opposing sides of the shield.

3. The plug connector module set forth in claim 2 wherein each half of the metal shield further comprises first and second wings that extend out of the respective half in a plane parallel to the substrate.

4. The plug connector module set forth in claim 3 wherein the first wing of the first half of the metal shield includes at least one hole that is aligned with a hole on the first wing of the second half of the metal shield and wherein the second wing of the first half of the metal shield includes at least one hole that is aligned with a hole on the second wing of the second half of the metal shield.

5. The plug connector module set forth in claim 1 wherein each of the first and second plurality of contacts consist of eight contacts spaced in a single row.

6. The plug connector module set forth in claim 5 wherein each of the first and second plurality of contacts includes a ground contact designated for ground, a first pair of data contacts configured to enable communication using a first communication protocol, a second pair of data contacts configured to enable communication using a second communication protocol different than the first protocol, a power in contact designated to carry a first power signal at a first voltage, a power out contact capable of carrying a second power signal at a second voltage lower than the first voltage, and an ID contact capable of carrying a configuration signal that identifies the communication protocols used by the first and second pairs of data contacts.

7. The reversible plug connector set forth in claim 6 wherein the first pair of data contacts in the first row and second row are positioned in a mirrored relationship directly opposite each other and the second pair of data contacts in the first row and second row are positioned in a mirrored relationship directly opposite each other.

8. The reversible plug connector set forth in claim 6 wherein the ground contacts in the first and second row are positioned in a cater corner relationship with each other across a centerline of the connector.

9. The reversible plug connector set forth in claim 6 wherein the first power contacts in the first and second row are positioned in a cater corner relationship with each other across a centerline of the connector.

10. The reversible plug connector set forth in claim 6 wherein the ID contacts in the first and second row are positioned in a cater corner relationship with each other across a first quarter line of the connector.

11. The reversible plug connector set forth in claim 6 wherein the second power contacts in the first and second row are positioned in a cater corner relationship with each other across a second quarter line of the connector.

12. The plug connector set forth in claim 6 wherein each of the first and second pairs of data contacts is positioned directly between two of the following contacts: the ground contact, the first power contact, the second power contact or the ID contact.

13. The plug connector set forth in claim 1 wherein the one or more electronic components includes an integrated circuit programmed with identification and configuration information about the plug connector that can be communicated to a host device during a mating event.

14. The plug connector set forth in claim 1 wherein the one or more electronic components includes an integrated circuit with an authentication module programmed to perform an authentication routine.

15. A plug connector module comprising:

a metal frame having a base portion, an insertion end and a cavity that extends from the base portion into the insertion end, the insertion end being configured to be inserted into a cavity of a corresponding receptacle connector and having width, height and length dimensions along with first and second opposing exterior surfaces extending in the width and length dimensions, the first exterior surface including a first opening and the second exterior surface including a second opening directly opposite the first opening;

a substrate that extends through the base portion of the frame and into the insertion end, the substrate having a plurality of contact bonding pads at one end positioned within the frame, a plurality of conductor bonding pads at the opposing end and at least one ground pad contact between the contact bonding pads and conductor bonding pads;

a first set of eight external contacts spaced apart along a single row and positioned within the first opening and bonded to at least some of the plurality of contact bonding pads on the substrate;

a second set of eight external contacts spaced apart along a single row and positioned within the second opening and bonded to at least some of the plurality of contact bonding pads on the substrate, wherein the second set of eight external contacts is positioned directly opposite the first set of eight external contacts;

one or more electronic components coupled to the substrate;

a first encapsulant that covers and environmentally seals the one or more electronic components;

a metal shield coupled to the base portion of the metal frame and to the ground pad and encasing a portion of the substrate and the one or more electronic components, wherein the metal shield includes first and second halves that are attached to the base portion and attached to each other at mating plates on opposing sides of the shield, the first half including first and second wings that extend out of the first half in a plane parallel to the substrate and the second half including a third and fourth wings that extend out of the second half in a plane parallel to the substrate; and a second encapsulant that covers and environmentally seals the ground pad and at least a portion of the leg.

16. The plug connector module set forth in claim 15 wherein the first wing of the first half of the metal shield includes at least one hole that is aligned with a hole on the third wing of the second half of the metal shield and wherein the second wing of the first half of the metal shield includes at least one hole that is aligned with a hole on the fourth wing of the second half of the metal shield.

17. The plug connector module set forth in claim 15 wherein each of the first and second sets of contacts includes a ground contact designated for ground, a first pair of data contacts to enable communication using a first communication protocol, a second pair of data contacts to enable communication using a second communication protocol different than the first protocol, a first power contact designated to carry a first power signal at a first voltage, a second power contact designated to carry a second power signal at a second voltage lower than the first voltage, and an ID contact capable of carrying a configuration signal that identifies the communication protocols used by the first and second pairs of data contacts.

18. The reversible plug connector set forth in claim 17 wherein the ground contacts in the first and second row are positioned in a cater corner relationship with each other across a centerline of the connector.

19. The reversible plug connector set forth in claim 17 wherein the first power contacts in the first and second row are positioned in a cater corner relationship with each other across a centerline of the connector.

20. The reversible plug connector set forth in claim 17 wherein the ID contacts in the first and second row are positioned in a cater corner relationship with each other across a first quarter line of the connector.

* * * * *